US009884223B1

(12) United States Patent
Hsiung

(10) Patent No.: US 9,884,223 B1
(45) Date of Patent: Feb. 6, 2018

(54) CRANK FOR EXERCISE EQUIPMENT WHICH HELPS PREVENT INJURIES ON A RIDER'S ANKLE DURING AN UNEXPECTED DROP IN SPEED AND ASSISTS IN AVOIDING STRESS ON THE KNEES OF A RIDER DURING EXERCISING

(71) Applicant: Bob Hsiung, Walnut, CA (US)

(72) Inventor: Bob Hsiung, Walnut, CA (US)

(73) Assignee: Hupa International Inc., City of Industry, CA (US)

( * ) Notice: Subject to any disclaimer, the term of this patent is extended or adjusted under 35 U.S.C. 154(b) by 0 days.

(21) Appl. No.: 15/482,612

(22) Filed: Apr. 7, 2017

Related U.S. Application Data

(62) Division of application No. 13/778,014, filed on Feb. 26, 2013, now Pat. No. 9,616,281.

(51) Int. Cl.
*A63B 21/00* (2006.01)
*A63B 22/00* (2006.01)
*A63B 22/06* (2006.01)

(52) U.S. Cl.
CPC ..... *A63B 22/0664* (2013.01); *A63B 21/159* (2013.01); *A63B 22/001* (2013.01); *A63B 2022/067* (2013.01); *A63B 2208/0233* (2013.01)

(58) Field of Classification Search
CPC ..... A61B 21/00058; A61B 21/00069; A61B 21/00072; A61B 21/00076; A61B 21/00181; A61B 21/00185; A61B 21/065; A61B 21/068; A61B 21/08; A61B 21/15; A61B 21/159; A61B 21/22; A61B 21/225; A61B 21/227; A61B 21/4001; A61B 21/4015; A61B 21/4027; A61B 21/4033; A61B 21/4034; A61B 21/4045; A61B 21/4047; A61B 21/4049; A61B 22/0046; A61B 22/0048; A61B 22/0061; A61B 22/0069; A61B 22/14; A61B 22/18; A61B 22/20; A61B 22/201; A61B 22/203; A61B 22/208; A61B 2022/0071; A61B 2022/0611; A61B 23/0205; A61B 23/0216; A61B 23/0222; A61B 23/035; A61B 23/03526; A61B 23/03533; A61B 23/04; A61B 23/0405; A61B 23/0417; A61B 23/0429; A61B 23/047; A61B 23/0482; A61B 23/0488; A61B 23/0494; A61B 2023/0447; A61B 26/00; A61B 26/003;

(Continued)

(56) References Cited

U.S. PATENT DOCUMENTS 2,421,884 A * 6/1947 Holmes ..... F02B 25/12 123/51 B
2,436,113 A * 2/1948 Main ..... B64C 39/005 244/9

(Continued)

*Primary Examiner* — Andrew S Lo
*Assistant Examiner* — Gary D Urbiel Goldner
(74) *Attorney, Agent, or Firm* — Thomas I. Rozsa

(57) ABSTRACT

An exercise equipment with an improved connecting bar connecting an exercise foot retaining device to a resistance, wherein a first longitudinal pedal bar is connected to a first bent longitudinal pedal connector bar and a second longitudinal pedal bar is connected to a second bent longitudinal pedal connector bar, the first and second bent longitudinal pedal connector bars each having a bent angle greater than zero and less than ninety degrees to thereby prevent an occurrence of a dead angle.

9 Claims, 7 Drawing Sheets

(58) Field of Classification Search
CPC ... A61B 69/0022; A61B 69/18; A61B 69/182; A61B 71/0054; A61B 2071/0072; A61B 2208/02; A61B 2208/0204; A61B 2225/09; A61B 2225/093; A61B 2225/096; A61B 2244/18; A61B 2244/183; A61B 2244/186; A61B 2244/19
See application file for complete search history.

(56) References Cited

U.S. PATENT DOCUMENTS 2,749,771 A * 6/1956 Pearl ..... B62M 3/02 74/562
2,775,178 A * 12/1956 Chambers ..... A01B 63/04 172/316
2,892,352 A * 6/1959 Bartlett ..... F04B 1/07 74/22 R
3,062,695 A * 11/1962 Hull ..... B29C 65/06 156/308.2
4,260,328 A * 4/1981 Hamel ..... F03D 3/068 416/109
4,434,790 A * 3/1984 Olesen ..... A61M 16/186 128/200.14
4,648,287 A * 3/1987 Preskitt ..... B62M 3/02 74/594.1
5,199,324 A * 4/1993 Sain ..... B62M 3/08 36/131
5,314,392 A * 5/1994 Hawkins ..... A63B 22/0056 482/52
5,634,382 A * 6/1997 Fan ..... B62M 3/04 74/594.1
5,759,136 A * 6/1998 Chen ..... A63B 22/0664 482/57
7,338,414 B1 3/2008 Hsiung
7,497,807 B2 * 3/2009 Neff ..... A63B 21/008 482/51
7,497,812 B2 * 3/2009 Neff ..... A63B 21/008 482/51
7,503,239 B2 * 3/2009 Yamanaka ..... B62M 3/00 403/230
7,473,210 B1 6/2009 Hsiung
7,600,771 B2 * 10/2009 Miller ..... B62J 1/28 280/252
7,713,178 B2 * 5/2010 Edmondson ..... A63B 21/154 482/110
7,780,577 B2 * 8/2010 Arnold ..... A63B 22/001 482/51
7,846,073 B2 * 12/2010 Summers ..... A63B 21/0603 482/135
7,918,768 B2 * 4/2011 Rogozinski ..... A63B 22/0015 482/51
7,951,048 B1 5/2011 Hsiung
7,867,146 B2 6/2011 Ge et al.
7,959,544 B2 * 6/2011 Palmer ..... A63B 21/0552 482/123
8,117,944 B2 * 2/2012 Stevovich ..... B62M 3/08 74/594.3
8,684,778 B1 * 4/2014 Bergman ..... B63H 16/04 440/101
8,961,373 B2 * 2/2015 Halver ..... A63B 21/157 482/51
2001/0052271 A1 * 12/2001 Orioli ..... B62M 3/04 74/594.3
2003/0060335 A1 * 3/2003 Wang ..... A63B 22/0023 482/51
2003/0061900 A1 * 4/2003 Smith ..... B62M 3/08 74/594.1
2003/0177999 A1 * 9/2003 Saito ..... F02F 7/0043 123/197.4
2004/0097335 A1 * 5/2004 Chu ..... A63B 22/001 482/51
2004/0147375 A1 * 7/2004 Stevens ..... A63B 22/001 482/57
2004/0241631 A1 * 12/2004 Nizamuddin ..... A63B 21/157 434/253
2006/0046902 A1 * 3/2006 Chang ..... A63B 22/0664 482/52
2006/0156857 A1 * 7/2006 Turner ..... G05G 1/085 74/545
2007/0093360 A1 * 4/2007 Neff ..... A63B 21/008 482/8
2007/0117680 A1 * 5/2007 Neff ..... A63B 21/008 482/8
2008/0011121 A1 * 1/2008 Topfer ..... B62M 3/08 74/594.6
2008/0020908 A1 * 1/2008 Ibarguren ..... A63B 22/0605 482/57
2008/0070729 A1 * 3/2008 Miller ..... B62J 1/28 474/101
2008/0132385 A1 * 6/2008 Alessandri ..... A63B 22/001 482/52
2008/0220943 A1 * 9/2008 Eschenbach ..... A63B 22/001 482/52
2008/0220947 A1 * 9/2008 Meng ..... A63B 21/225 482/62
2009/0176624 A1 * 7/2009 Chang ..... A63B 22/001 482/52
2009/0234369 A1 * 9/2009 Bax ..... A61B 19/201 606/130
2009/0239713 A1 * 9/2009 Chu ..... A63B 21/225 482/51
2010/0298101 A1 * 11/2010 Teal ..... B62K 3/002 482/52
2011/0143884 A1 * 6/2011 Chu ..... A63B 21/225 482/51
2012/0270194 A1 * 10/2012 Kuijpers ..... A63B 21/0053 434/253

* cited by examiner

PRIOR ART

PRIOR ART

CRANK FOR EXERCISE EQUIPMENT WHICH HELPS PREVENT INJURIES ON A RIDER'S ANKLE DURING AN UNEXPECTED DROP IN SPEED AND ASSISTS IN AVOIDING STRESS ON THE KNEES OF A RIDER DURING EXERCISING

CROSS-REFERENCE TO RELATED APPLICATION

This patent application is a divisional of application Ser. No. 13/778,014 filed on Feb. 26, 2013, now pending.

BACKGROUND OF THE INVENTION

1. Field of the Invention

The present invention relates to the field of exercise equipment and in particular, to different types of exercise equipment such as elliptical trainers, recumbent bicycles, standard bicycles, horse riding simulating physical fitness devices and devices to simulate skating.

2. Description of the Prior Art

The present inventor is a major innovator in the present field of invention. The present inventor has the following patents for which improvement in the crank handle would be very beneficial:

1. U.S. Pat. No. 7,338,414 issued to Bob Hsiung on Mar. 4, 2008 for "APPARATUS TO ENABLE A USER TO SIMULATE SKATING";
2. U.S. Pat. No. 7,473,210 issued to Bob Hsiung on Jun. 6, 2009 for "APPARATUS TO ENABLE A USER TO SIMULATE SKATING".
3. U.S. Pat. No. 7,951,048 issued to Bob Hsiung on May 31, 2001 for "ABDOMINAL SWIVELING EXERCISE MACHINE COMBINED WITH AN ELLIPTICAL TRAINER EXERCISE MACHINE OR SKATE SIMULATION TRAINER OR EXERCISE BICYCLE OR RECUMBENT BICYCLE".
4. U.S. Pat. No. 7,867,146 issued to Ge et al. on Jun. 11, 2011 for "HORSE-RIDING SIMULATING PHYSICAL DEVICE" which has been assigned Bob Hsiung.

There is a significant need for an improvement in the crank mechanism of these devices to help improve the exercise when the machine is used as an exercise bicycle, recumbent bicycle and elliptical trainer.

SUMMARY OF THE INVENTION

The present invention relates to an improved crank for exercise equipment. The purpose of the new design for the crank is to avoid a lesser speed upon pedaling so that the energy required for biking is minimized since no energy is wasted. More importantly, the present invention crank helps prevent injuries on the ankle during an unexpected drop in speed and to avoid stress on the knees during exercising.

The angle that the crank makes has to be between zero and 90 degrees. Every force can be broken into its horizontal and vertical components. In the horizontal force, the vertical component equals 0. Similarly, a vertical force has a zero horizontal component.

The equation is $H=F \cos \beta$ and $V=F \sin \beta$

In trigonometry, cos 90°, cos 270°, sin 0° and sin 180° equal 0, thus creating a force component of 0. That is the rationale on which the present invention design is based.

When one of the forces equals 0 at the following angles, 0, 90, 180, and 270 degrees, the total force becomes less. That is the reason when during full force pedaling, people experience a drop in velocity, and that can be easily felt as a light jerk. The higher the original speed, the higher the drop will be due to sensational contrast. Sometimes, that causes the peddler's foot to come off the footrest, and that can be damaging to the user's ankles and knees.

The present invention crank is slightly angled to prevent the peddler getting into one of the four 0 components mentioned above. As a result, the peddling will be a much smoother experience.

It is therefore an object of the present invention to create an improved crank to be used for exercise equipment such as regular bicycling, recumbent bicycling, elliptical trainers, machines to simulate skating etc. where the angles which result in a zero horizontal or vertical force are eliminated due to the angle of the crank and therefore, to eliminate a zero speed drop which could result in injury to the user's ankles or knees.

Defined in detail, the present invention is an apparatus to simulate skating having at least a rear transverse frame and a front transverse frame which are interconnected by a longitudinal frame, a right pedal assembly having a right longitudinal pedal bar to which a right foot pedal is connected, the right longitudinal pedal bar is rotatably connected to the front transverse frame by a first rod, a left pedal assembly having a left longitudinal pedal bar to which a left foot pedal is connected, the left longitudinal pedal bar is rotatably connected to the front transverse frame by a second rod, the right and left pedal assemblies are spaced apart and side by side to each other and located along opposite sides of the longitudinal frame, a flywheel assembly which facilitates a sliding back and forth motion of the foot pedals to simulate skating, an improved pedal connector bar assembly comprising: (a) a crank connected at its first end to a crank axle and connected at its second end to a connecting rod connected to the flywheel assembly so that the crank rotates as the skate foot pedals of the skating machine move to simulate skating; (b) a right pedal connector bar formed in one piece and having a first section with a first interior end and a second interior end, a second section with an exterior end and an interior end, a middle bent section with a first end and a second end, the middle bent section bent at an angle above zero degrees and less than ninety degrees, the first interior end of the first section connected to the crank axle, the second interior end of the first section connected to the first end the middle bent section, the exterior end of the second section rotatably connected to a rear of the first longitudinal pedal bar and the interior end of the second section connected to the second end of the middle bent section, the first section, the middle bent section and the second section are all in the same horizontal plane; and (c) a left pedal connector bar formed in one piece and having a first section with a first interior end and a second interior end, a second section with an exterior end and an interior end, a middle bent section with a first end and a second end, the middle bent section bent at an angle above zero degrees and less than ninety degrees, the first interior end of the first section connected to the crank axle, the second interior end of the first section connected to the first end the middle bent section, the exterior end of the second section rotatably connected to a rear of the left longitudinal pedal bar and the interior end of the second section connected to the second end of the middle bent section, the first section, the middle bent section and the second section are all in the same horizontal plane; (d) whereby the bent angle of the middle section of the right connector bar avoids a dead angle with zero force on the right connector bar and the bent angle of the middle section of the left connector bar avoids a dead angle with zero force on the left connector bar.

Defined more broadly, the present invention is an apparatus to simulate skating having at least a right pedal assembly having a first longitudinal pedal bar to which a first foot pedal is connected, the first longitudinal pedal bar is rotatably connected to a front transverse frame, a left pedal assembly having a second longitudinal pedal bar to which a second foot pedal is connected, the second longitudinal pedal bar is rotatably connected to the front transverse frame, the first and second foot pedal assemblies are spaced apart and side by side to each other and located along opposite sides of a longitudinal frame, a mechanism which facilitates a sliding back and forth motion of the foot pedals to simulate skating, an improved pedal connector bar assembly comprising: (a) a crank which is connected at its first end to a crank axle and connected at its second end to the mechanism which facilitates the sliding back and forth motion of the foot pedals of the skating machine to simulate skating; and (b) a bent right pedal connector bar bent at an angle above zero degrees and below ninety degrees, the right bent pedal connector bar rotatably connecting the crank axle to a rear of the first longitudinal pedal bar and a bent left pedal connector bar bent at an angle above zero degrees and below ninety degrees, the left bent pedal connector bar rotatably connecting the crank axle to a rear of the second longitudinal pedal bar; (c) whereby the bent angle of the middle section of the bent right connector bar avoids a dead angle with zero force on the bent right connector bar and the bent angle of the middle section of the bent left connector bar avoids a dead angle with zero force on the bent left connector bar.

Defined most broadly, the present invention is an apparatus to simulate skating having at least a right pedal assembly having a first longitudinal pedal bar to which a first foot pedal is connected, a left pedal assembly having a second longitudinal pedal bar to which a second foot pedal is connected, the first and second foot pedal assemblies are spaced apart and rotatably connected to a mechanism which facilitates a sliding back and forth motion of the right pedal assembly and the left pedal assembly, improved connector bar assembly comprising: (a) a moving member is connected at its first end to a crank axle and connected at its second end to the mechanism which facilitates the sliding back and forth motion of the right and left+pedal assemblies; and (b) a bent right pedal connector bar bent at an angle above zero degrees and below ninety degrees, the right bent pedal connector bar rotatably connecting the crank axle to a rear of the first longitudinal pedal bar and a bent left pedal connector bar bent at an angle above zero degrees and below ninety degrees, the left bent pedal connector bar rotatably connecting the crank axle to a rear of the second longitudinal pedal bar; (c) whereby the bent angle of the middle section of the bent right connector bar avoids a dead angle with zero force on the bent right connector bar and the bent angle of the middle section of the bent left connector bar avoids a dead angle with zero force on the bent left connector bar.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
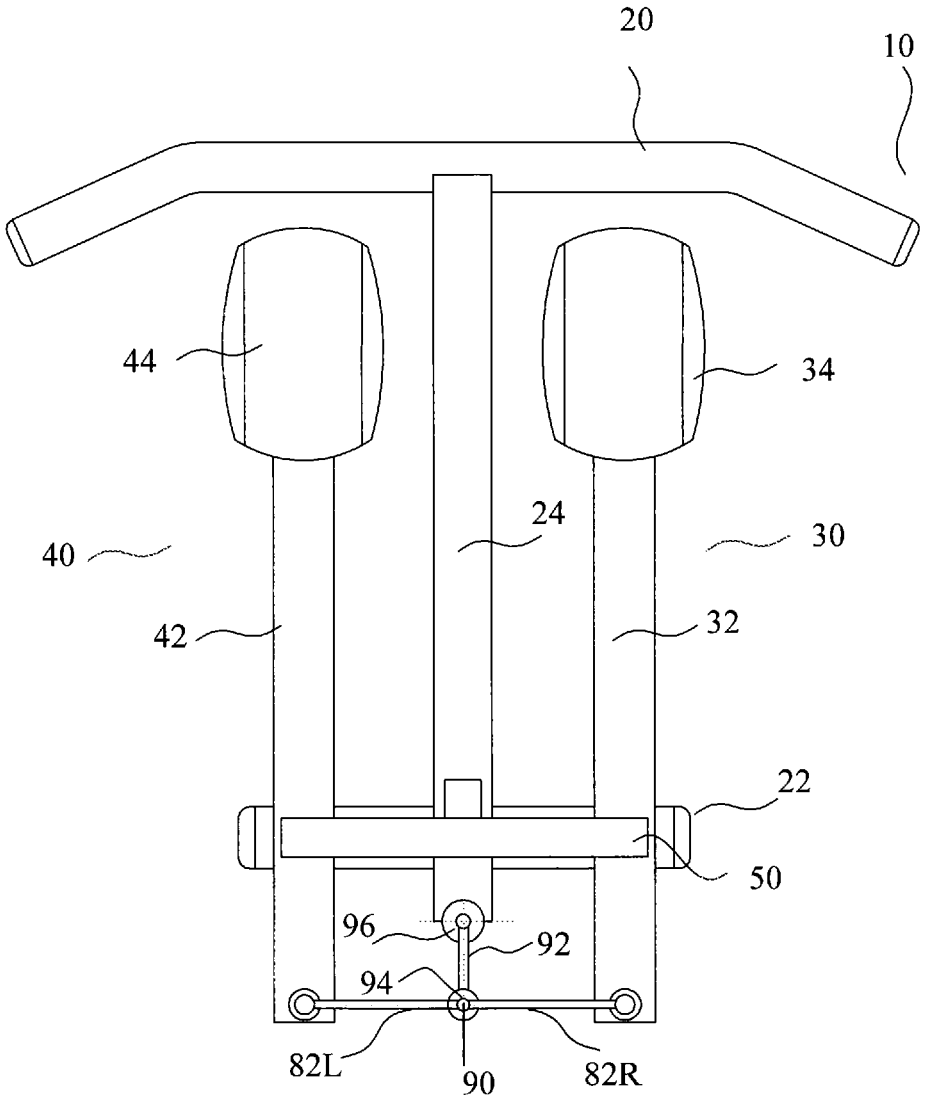
FIG. 1 is a perspective view of a relevant portion of an exercise machine to simulate skating including prior art straight pedal connector bars.

There is illustrated the fundamental structure of an apparatus to simulate skating which is described in greater detail in U.S. Pat. No. 7,338,414 ("'414 Patent"). Referring to FIG. 1 of the '414 Patent, a portion of which is illustrated in FIG. 1 of the present application, the basic structure of the skating machine 10 is supported on a rear transverse frame 20 and a front transverse frame 22 which are interconnected by a longitudinal frame 24. The skating machine 10 further comprises a first or right pedal assembly 30 having a first or right longitudinal pedal bar 32 to which a first or right foot pedal 34 is connected. The first longitudinal pedal bar 32 is rotatably connected to the front transverse frame 22 by a first rod which is not shown in FIG. 1 of the present application but is shown in FIG. 1 of the '414 Patent. The skating machine 10 further comprises a second or left pedal assembly 40 having a second or left longitudinal pedal bar 42 to which a second or left foot pedal 44 is connected. The second longitudinal pedal bar 42 is rotatably connected to the front transverse frame 22 by a second rod 46 illustrated in FIG. 1 of the '414 Patent but not illustrated in FIG. 1 of the present application.

First and second foot pedal assemblies 30 and 40 are spaced apart and side by side to each other and located along opposite sides of the longitudinal frame 24. Rods 36 and 46 (as shown in FIG. 1 of the '414 Patent) are also connected to an upper transverse beam 50 which supports an upper transverse frame. This is the portion from the '414 Patent that is illustrated in FIG. 1 of the present application.

The upper transverse frame supports a flywheel assembly which facilitates a sliding back and forth motion of the foot pedals 34 and 44 to simulate skating. The skating simulation operation is described in the '414 Patent. A crank 92 is connected at its first end 94 to the crank axle 90 and connected at its second end 96 to a connecting rod or pulley axle so that the crank 92 rotates as the skate foot pedals of the skating machine move to simulate skating. The crank axle 90 is rotatably connected to a right pedal connector bar 82R which connects the crank 92 to a rear of the longitudinal pedal bar 32 and is also connected to the left pedal connector bar 82L which connects the crank 92 to a rear of the longitudinal pedal bar 42. If the pedal connector bars 82R and 82L are straight, at a point in the motion of the foot pedal assemblies, the pedal connector bars 82R and 82L reach a "dead" or "0" angle as illustrated in FIG. 1 of the present application.

The angle that the crank 92 makes has to be between greater than zero and less than 90 degrees. Every force can be broken into its horizontal and vertical components. In the horizontal force, the vertical component equals zero (0). Similarly, a vertical force has a zero horizontal component.

The equation is $H=F \cos \beta$ and $V=F \sin \beta$

In trigonometry, cos 90°, cos 270°, sin 0° and sin 180° equal s zero (0), thus creating a force component of zero (0). That is the rationale on which the present invention design is based. When one of the forces equals zero (0) at the following angles, 0, 90, 180, and 270 degrees, the total force becomes less. That is what is illustrated in FIG. 1 where the right pedal connector bar 82R and left pedal connector bar 82L are straight and locked at a "dead" zero angle which means the crank 92 is also locked at a dead zero angle leaving the problems identified above. That is the reason when during full force pedaling, people experience a drop in velocity, and that can be easily felt as a light jerk. The higher the original speed, the higher the drop will be due to sensational contrast. Sometimes, that causes the peddler's foot to come off the footrest, and that can be damaging to the user's ankles and knees.

The present invention right pedal connector bar and left pedal connector bar are slightly angled to prevent the peddler getting into one of the four zero (0) components mentioned above. As a result, the peddling will be a much smoother experience.

Figure 2:
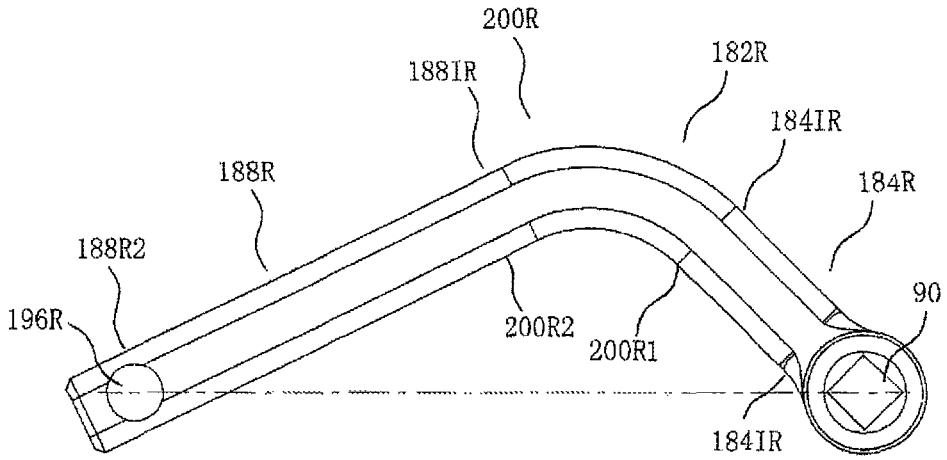
FIG. 2 is a perspective view of the present invention right pedal connector bar, drawn 190 degrees counterclockwise to match the drawing in FIG. 5.

FIG. 2 illustrates a perspective view of a present invention right pedal connector bar 182R having a first section 184R which is connected at its interior 184IR to the crank axle 90 and a second interior end 1841R connected to a middle bent section 200R at a first end 200R1 and a second section 188R with an exterior end 188R2 rotatably connected to a rear of the longitudinal pedal bar 32 by pin 196R and an interior end 188IR connected to a second end 200R2 of bent section 200R. Therefore instead of being a straight pedal bar connector such as prior art pedal connector 82R, the present invention right pedal bar connector 182R is bent in the middle at any angle above zero and less than 90 degrees to avoid the dead angle with a zero force as previously described. The right pedal connector bar is illustrated rotated 190 degrees counterclockwise to match the drawing in FIG. 5, and to make the numbers easier to read.

Figure 3:
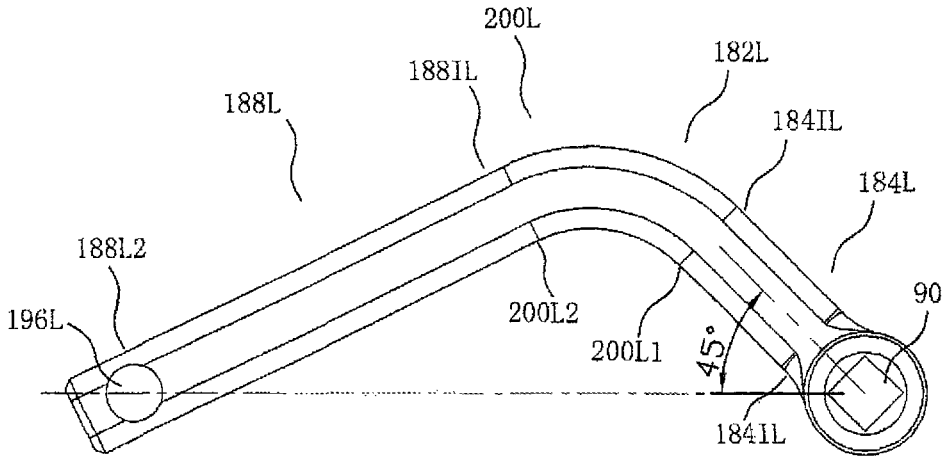
FIG. 3 is a perspective view of the present invention left pedal connector bar, which matches the drawing in FIG. 5.

FIG. 3 illustrates a perspective view of a present invention left pedal connector bar 182L having a first section 184L which is connected at its interior 184IL to the crank axle 90 and a second interior end 1841L connected to a middle bent section 200L at a first end 200L1 and a second section 188L with an exterior end 188L2 rotatably connected to a rear of the longitudinal pedal bar 42 by pin 196L and an interior end 188IL connected to a second end 200L2 of bent section 200L. Therefore instead of being a straight bar such as prior art pedal bar connector 82L, the present invention left pedal bar 182LR is bent in the middle at any angle above zero and less than 90 degrees to avoid the dead angle with a zero force as previously described. The left pedal connector bar is illustrated to match the drawing in FIG. 5.

Figure 4:
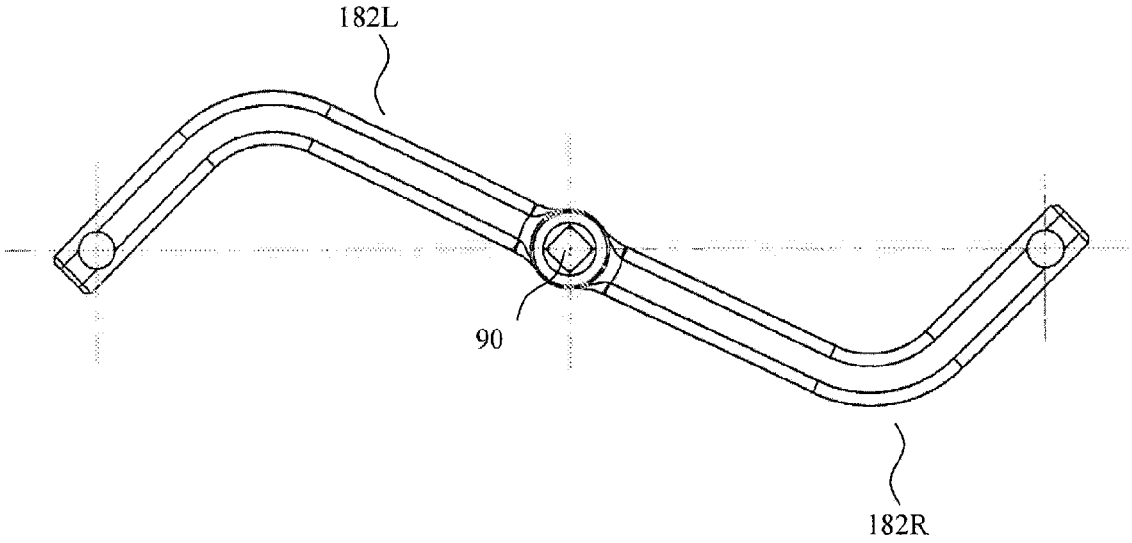
FIG. 4 is a perspective view of the left pedal connector bar and right pedal connector bar connected at the location of the crank axle.
Figure 5:
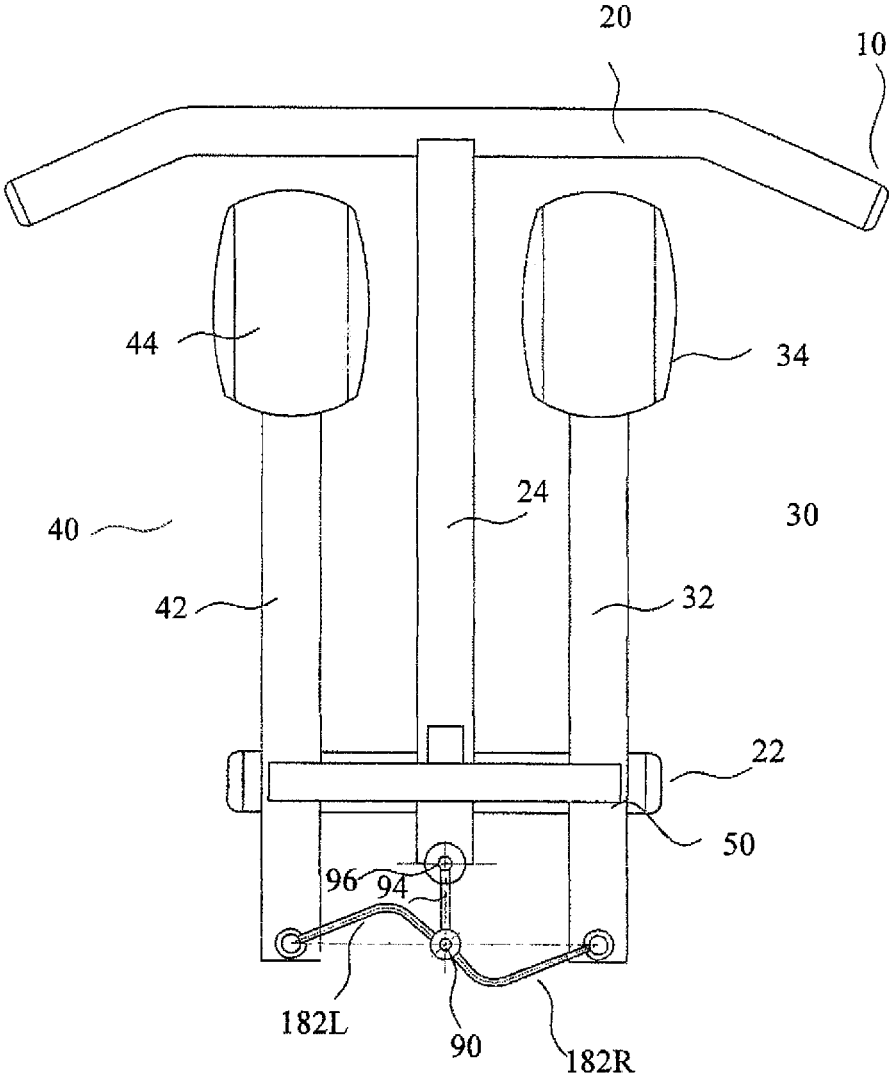
FIG. 5 is a perspective view of a relevant portion of an exercise machine to simulate skating including the present invention left and right bent pedal connector bars.

Referring to FIG. 4, the entire two bent left pedal connector bar 182L and bent right pedal connector bar 182R are shown connected at the location of the crank axle 90 of crank 92. Referring to FIG. 5, there is illustrated a portion of the skating machine described in FIG. 1, with the straight right pedal bar connector 82R and straight left pedal bar connector 82L replaced with the bent right pedal bar connector bar 182R and bent left pedal connector bar 182L. As a result of the bent pedal connector bars, a dead angle is avoided and there is no zero horizontal force and no zero vertical force, resulting in the benefits previously described.

While each bent pedal connector bar 182L and 182R is illustrated in three sections, a first section, a middle bent section and a second section, it will be appreciated that each bent pedal connector bar 182L and 182R can be formed in one piece with the bent angle as illustrated. It is also possible for each bent pedal connector bar to be formed of two pieces with the bent angle as illustrated.

FIG. 5 is a perspective view of a relevant portion of the exercise machine to simulate skating including the present invention left and right pedal bar connector. FIG. 5 is drawn exactly the same as the prior art FIG. 1 except that the pedal bar connectors 182R and 182L are modified to eliminate the zero angle and replace 82R and 82L in FIG. 1. Therefore, the present invention is illustrated in a skating machine in FIG. 1 with the prior art and is illustrated with the present invention installed in FIG. 5.

Therefore, an object of the present invention to create an improved pedal bar connector to be used for exercise equipment such as regular bicycling, recumbent bicycling, elliptical trainers, machines to simulate skating etc. where the angles which result in a zero horizontal or vertical force are eliminated due to the angle of the pedal bar connectors to eliminate a zero speed drop has been achieved.

Figure 6:
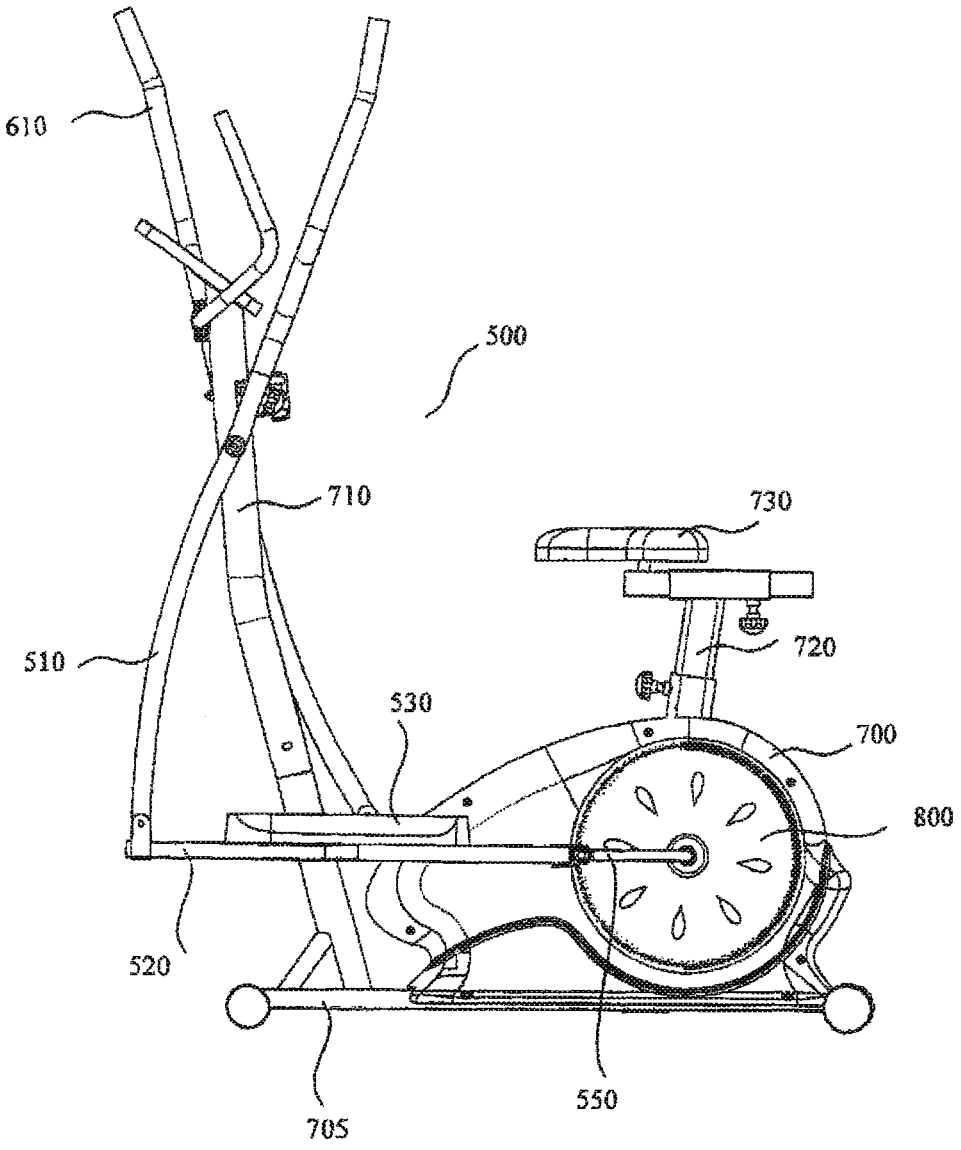
FIG. 6 is a perspective view of an exercise device including an elliptical trainer, a vertical bicycle and a recumbent bicycle, with prior art straight connector bars.

The above concept can also be applied to an elliptical trainer or any sit down vertical bicycle or recumbent bicycle where the power is generated by a force against a resistance rotating wheel attached to the foot plate pedal bar by a pedal bar connector. Referring to FIG. 6, a conventional elliptical trainer which includes a seated bicycle and a recumbent bicycle 500 includes a first or left handle 510 rotatably attached to the first or left longitudinal pedal bar 520 to which a first or left foot plate 530 is attached. A second or right handle 610 includes a corresponding rotatably attached second or right longitudinal pedal bar to which a second or right foot plate is attached. The elliptical trainer or bicycle 500 includes a body 700 having at least a base 705, a vertical post 710 between handles 510 and 610 and a bicycle seat post 720 supporting a seat 730. The power is generated from a resistance wheel 800 which is rotatably connected to the first longitudinal pedal bar 520 by a first longitudinal pedal bar connector 550. It will be appreciated that a mirror image longitudinal second pedal connector bar is rotatably connected to the resistance wheel and is connected to a second longitudinal pedal bar. The prior art as illustrated in FIG. 6 has a straight longitudinal pedal connector bar 550. As a result, the straight pedal longitudinal pedal connector bar creates a "dead" angle when locked in the straight horizontal orientation as illustrated in FIG. 6, whereby the resultant zero vertical force and zero horizontal force which creates the problems as discussed above occurs.

Figure 7:
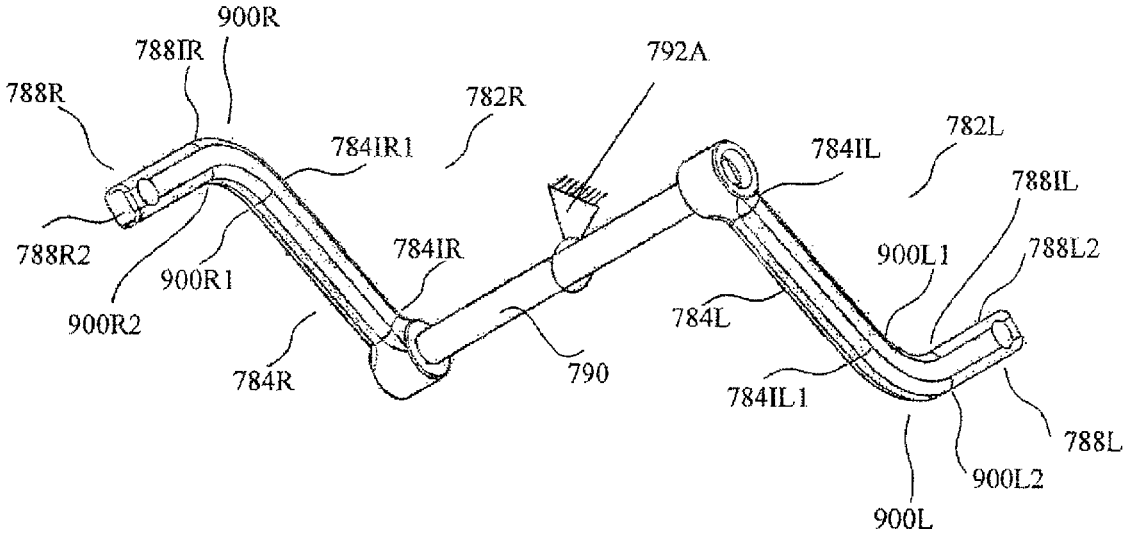
FIG. 7 is a perspective view of the present invention bent right pedal connector bar and bent left pedal connector bar connected to a connecting rod.

The improvement comprises having bent longitudinal connector bar members. FIG. 7 illustrates a pair of bent longitudinal pedal connector bars attached at opposite ends of a connecting rod 790 which extends through and is connected to and drives the resistance wheel 800. The connecting rod 790 is connected by connecting member 792A to the driving wheel 800.

FIG. 7 includes a perspective view of a present invention right pedal connector bar 782R having a first section 784R which is connected at its interior 7841R to the connecting rod 790 connected to the resistance wheel 800 and a second interior end 7841R1 connected to a middle bent section 900R at a first end 900R1 and a second section 788R with an exterior end 788R2 rotatably connected to a rear of the longitudinal pedal bar and an interior end 7881R connected to a second end 900R2 of bent section 900R. Therefore instead of being a straight pedal connector bar such as prior art pedal connector 550, the present invention right pedal bar connector 782R is bent in the middle at any angle above zero and less than 90 degrees to avoid the dead angle with a zero force as previously described.

FIG. 7 further includes a perspective view of a present invention left pedal connector bar 782L having a first section 784L which is connected at its interior 7841L to the connecting rod 790 and a second interior end 7841L1 connected to a middle bent section 900L at a first end 900L1 and a second section 788L with an exterior end 788L2 which is rotatably connected to a rear of the longitudinal pedal bar 520 and an interior end 7881L connected to a second end 900L2 of bent section 900L. Therefore instead of being a straight bar such as prior art pedal bar connector 550, the present invention left pedal bar 782L is bent in the middle at any angle above zero and less than 90 degrees to avoid the dead angle with a zero force as previously described.

Figure 8:
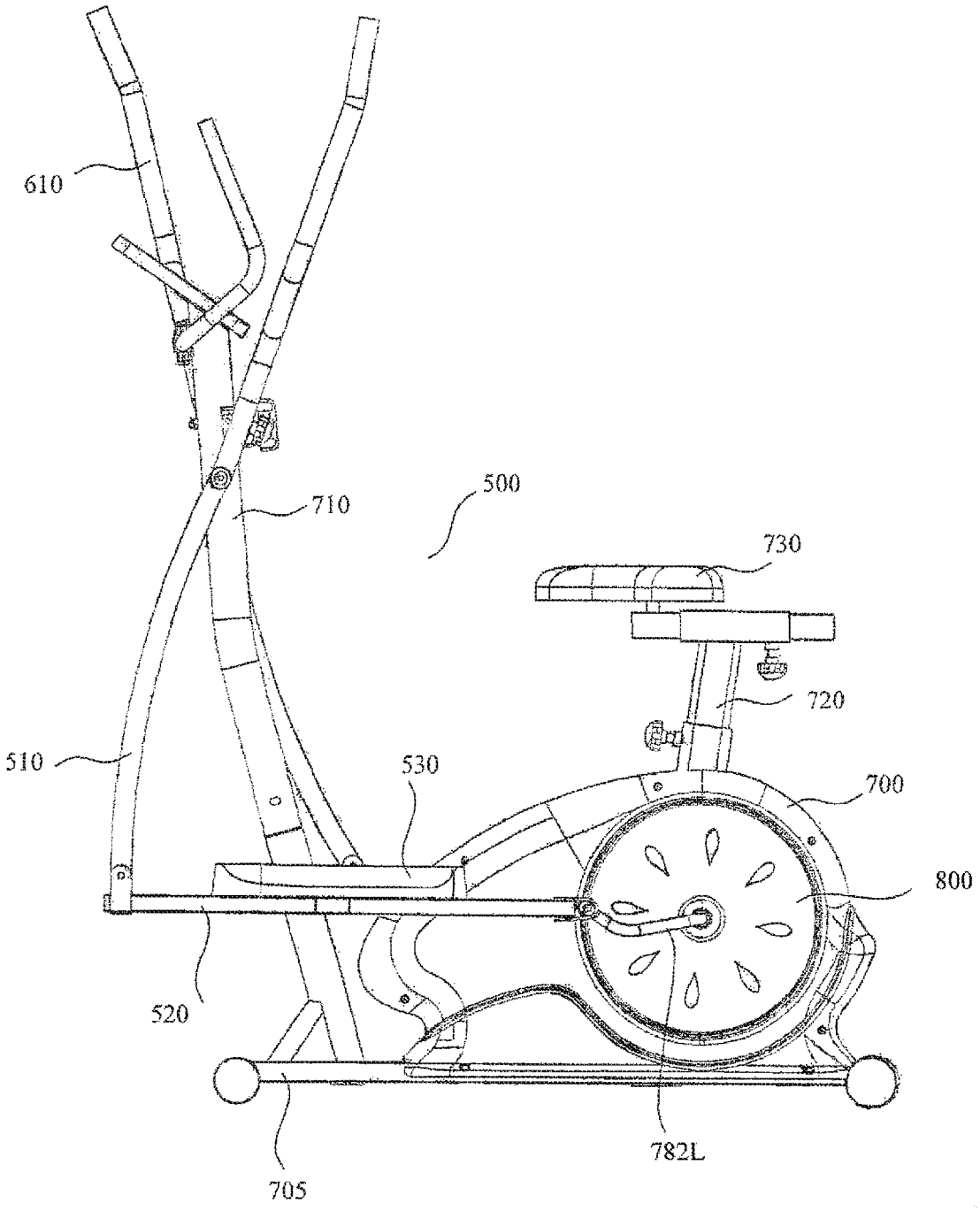
FIG. 8 is a perspective view of a relevant portion of an exercise machine including an elliptical trainer, a vertical bicycle and a recumbent bicycle, with the present invention bent left and right connector bars.

Referring to FIG. 8, this illustrates the exact same view of an exercise device including an elliptical trainer, a vertical bicycle and a recumbent bicycle as illustrated in FIG. 6 with the only change being the replacement of the prior art first longitudinal pedal bar 550 being connected to the first longitudinal pedal bar 520 and instead, the new bent left pedal bar 782L is illustrated connected to the first longitudinal pedal bar 520 to avoid the problem of the zero angle being created by the prior art. It will be appreciated that the right pedal bar connector 782R will be connected to the corresponding left second longitudinal pedal bar connected to the right foot pedal. Therefore, through the bent angle connector bars as illustrated in FIG. 7, the zero angle is avoided. In FIG. 7, the connecting rod 790 is shown attached to a connecting member 792A which connects the connecting rod to the driving wheel 800.

Further referring to FIG. 8, there is illustrated a portion of the elliptical trainer described in FIG. 6, with the straight right pedal bar connector not shown replaced with the bent right pedal bar connector 782R (not shown in this figure) and the straight left pedal bar connector 550 illustrated in FIG. 6 replaced with the left bent pedal bar connector 782L which in turn is connected to the first longitudinal pedal bar 520. As a result of the bent pedal connector bars, a dead angle is avoided and there is no horizontal force and no vertical force, resulting in the benefits previously described.

While each bent pedal connector bar 782L and 782R is illustrated in three sections, a first section, a middle bent section and a second section, it will be appreciated that each bent pedal connector bar section 782L and 782R can be formed in one piece with the bent angle as illustrated. It is also possible for each bent pedal connector bar to be formed of two pieces with the bent angle as illustrated.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus to simulate skating having a rear transverse frame and a front transverse frame which are interconnected by a longitudinal frame, a right pedal assembly having a right longitudinal pedal bar to which a right foot pedal is connected, the right longitudinal pedal bar is rotatably connected to the front transverse frame by a first rod, a left pedal assembly having a left longitudinal pedal bar to which a left foot pedal is connected, the left longitudinal pedal bar is rotatably connected to the front transverse frame by a second rod, the right and left pedal assemblies are spaced apart and side by side to each other and located along opposite sides of the longitudinal frame, a flywheel assembly which facilitates a sliding back and forth motion of the foot pedals to simulate skating, an improved pedal connector bar assembly comprising:

a. a crank connected at a first end to a crank axle and connected at a second end to a connecting rod connected to the flywheel assembly so that the crank rotates as the foot pedals of the apparatus move to simulate skating;

b. a right pedal connector bar formed in one piece and having a first section with a first interior end and a second interior end, a second section with an exterior end and an interior end, a middle bent section with a first end and a second end, the middle bent section bent at an angle above zero degrees and less than ninety degrees, the first interior end of the first section connected to the crank axle, the second interior end of the first section connected to the first end of the middle bent section, the exterior end of the second section rotatably connected to a rear of the right longitudinal pedal bar, and the interior end of the second section connected to the second end of the middle bent section, the first section, the middle bent section and the second section are all in a same horizontal plane; and c. a left pedal connector bar formed in one piece and having a first section with a first interior end and a second interior end, a second section with an exterior end and an interior end, a middle bent section with a first end and a second end, the middle bent section of the left pedal connector bar bent at an angle above zero degrees and less than ninety degrees, the first interior end of the first section of the left pedal connector bar connected to the crank axle, the second interior end of the first section of the left pedal connector bar connected to the first end of the middle bent section of the left pedal connector bar, the exterior end of the second section of the left pedal connector bar rotatably connected to a rear of the left longitudinal pedal bar, and the interior end of the second section of the left pedal connector bar connected to the second end of the middle bent section of the left pedal connector bar, the first section, the middle bent section and the second section of the left pedal connector bar are all in the same horizontal plane;

d. whereby the bent angle of the middle bent section of the right pedal connector bar avoids a dead angle with zero force on the right pedal connector bar and the bent angle of the middle bent section of the left pedal connector bar avoids a dead angle with zero force on the left pedal connector bar.

2. An apparatus to simulate skating having a right pedal assembly having a first longitudinal pedal bar to which a first foot pedal is connected, the first longitudinal pedal bar is rotatably connected to a front transverse frame, a left pedal assembly having a second longitudinal pedal bar to which a second foot pedal is connected, the second longitudinal pedal bar is rotatably connected to the front transverse frame, the first and second pedal assemblies are spaced apart and side by side to each other and located along opposite sides of a longitudinal frame, a mechanism which facilitates a sliding back and forth motion of the foot pedals to simulate skating, an improved pedal connector bar assembly comprising:

a. a crank which is connected at a first end to a crank axle and connected at a second end to the mechanism which facilitates the sliding back and forth motion of the foot pedals of the apparatus to simulate skating; and b. a right bent pedal connector bar bent at an angle above zero degrees and below ninety degrees, the right bent pedal connector bar rotatably connecting the crank axle to a rear of the first longitudinal pedal bar and a left bent pedal connector bar bent at an angle above zero degrees and below ninety degrees, the left bent pedal connector bar rotatably connecting the crank axle to a rear of the second longitudinal pedal bar;

c. whereby the bent angle of the right bent pedal connector bar avoids a dead angle with zero force on the right bent pedal connector bar and the bent angle of the left bent pedal connector bar avoids a dead angle with zero force on the left bent pedal connector bar, and whereby the respective bent angles of the right and left bent pedal connector bars are in a same horizontal plane.

3. The apparatus to simulate skating in accordance with claim 2, further comprising:

a. said right bent pedal connector bar having a first section with a first interior end and a second interior end, a second section with an exterior end and an interior end, a middle bent section with a first end and a second end, the middle bent section bent at the angle above zero degrees and less than ninety degrees, the first interior end of the first section connected to the crank axle, the second interior end of the first section connected to the first end of the middle bent section, the exterior end of the second section rotatably connected to the rear of the first longitudinal pedal bar, and the interior end of the second section connected to the second end of the middle bent section, the first section, the middle bent section and the second section are all in the same horizontal plane; and b. said left bent pedal connector bar having a first section with a first interior end and a second interior end, a second section with an exterior end and an interior end, a middle bent section with a first end and a second end, the middle bent section of the left bent pedal connector bar bent at the angle above zero degrees and less than ninety degrees, the first interior end of the first section of the left bent pedal connector bar connected to the crank axle, the second interior end of the first section of the left bent pedal connector bar connected to the first end of the middle bent section of the left bent pedal connector bar, the exterior end of the second section of the left bent pedal connector bar rotatably connected to the rear of the second longitudinal pedal bar, and the interior end of the second section of the left bent pedal connector bar connected to the second end of the middle bent section of the left bent pedal connector bar, the first section, the middle bent section and the second section of the left bent pedal connector bar are all in the same horizontal plane.

4. The apparatus to simulate skating in accordance with claim 2, further comprising said right bent pedal connector bar is formed in one piece and said left bent pedal connector bar is formed in one piece.

5. The apparatus to simulate skating in accordance with claim 3, further comprising a. said right bent pedal connector bar including the first section, the middle bent section and the second section is formed in one piece and said left bent pedal connector bar including the first section, the middle bent section and the second section is formed in one piece.

6. An apparatus to simulate skating having a right pedal assembly having a first longitudinal pedal bar to which a first foot pedal is connected, a left pedal assembly having a second longitudinal pedal bar to which a second foot pedal is connected, the first and second pedal assemblies are spaced apart and rotatably connected to a mechanism which facilitates a sliding back and forth motion of the right pedal assembly and the left pedal assembly, an improved connector bar assembly comprising:

a. a moving member connected at a first end to a crank axle and connected at a second end to the mechanism which facilitates the sliding back and forth motion of the right and left pedal assemblies; and b. a right bent pedal connector bar bent at an angle above zero degrees and below ninety degrees, the right bent pedal connector bar rotatably connecting the crank axle to a rear of the first longitudinal pedal bar and a left bent pedal connector bar bent at an angle above zero degrees and below ninety degrees, the left bent pedal connector bar rotatably connecting the crank axle to a rear of the second longitudinal pedal bar;

c. whereby the bent angle of the right bent pedal connector bar avoids a dead angle with zero force on the right bent pedal connector bar and the bent angle of the left bent pedal connector bar avoids a dead angle with zero force on the left bent pedal connector bar, and whereby the respective bent angles of the right and left bent pedal connector bars are in a same horizontal plane.

7. The apparatus to simulate skating in accordance with claim 6, further comprising:

a. said right bent pedal connector bar having a first section with a first interior end and a second interior end, a second section with an exterior end and an interior end, a middle bent section with a first end and a second end, the middle bent section bent at the angle above zero degrees and less than ninety degrees, the first interior end of the first section connected to the crank axle, the second interior end of the first section connected to the first end of the middle bent section, the exterior end of the second section rotatably connected to the rear of the first longitudinal pedal bar, and the interior end of the second section connected to the second end of the middle bent section, the first section, the middle bent section and the second section are all in the same horizontal plane; and b. said left bent pedal connector bar having a first section with a first interior end and a second interior end, a second section with an exterior end and an interior end, a middle bent section with a first end and a second end, the middle bent section of the left bent pedal connector bar bent at the angle above zero degrees and less than ninety degrees, the first interior end of the first section of the left bent pedal connector bar connected to the crank axle, the second interior end of the first section of the left bent pedal connector bar connected to the first end of the middle bent section of the left bent pedal connector bar, the exterior end of the second section of the left bent pedal connector bar rotatably connected to the rear of the second longitudinal pedal bar, and the interior end of the second section of the left bent pedal connector bar connected to the second end of the middle bent section of the left bent pedal connector bar, the first section, the middle bent section and the second section of the left bent pedal connector bar are all in the same horizontal plane.

8. The apparatus to simulate skating in accordance with claim 6, further comprising said right bent pedal connector bar is formed in one piece and said left bent pedal connector bar is formed in one piece.

9. The apparatus to simulate skating in accordance with claim 7, further comprising a. said right bent pedal connector bar including the first section, the middle bent section and the second section is formed in one piece and said left bent pedal connector bar including the first section, the middle bent section and the second section is formed in one piece.

* * * * *